United States Patent [19]

Stutts

[11] Patent Number: 4,904,370

[45] Date of Patent: Feb. 27, 1990

[54] ELECTROCHEMICAL ORGANIC REACTIONS VIA CATALYTIC HALIDE SUBSTITUTION

[75] Inventor: Kenneth J. Stutts, Midland, Mich.

[73] Assignee: The Dow Chemical Company, Midland, Mich.

[21] Appl. No.: 192,748

[22] Filed: May 9, 1988

[51] Int. Cl.[4] ..... C25B 3/10

[52] U.S. Cl. ..... 204/59 R; 204/81

[58] Field of Search ..... 204/59 R, 81

[56] References Cited

U.S. PATENT DOCUMENTS

| | | | |
|---|---|---|---|
| 3,799,999 | 3/1974 | Gordon | 570/260 |
| 3,876,514 | 4/1975 | Baizer | 204/59 R |
| 3,899,542 | 8/1975 | Starks | 570/260 |
| 4,253,921 | 3/1981 | Baldwin et al. | 204/72 |
| 4,324,625 | 4/1982 | Cumbo | 204/72 |

FOREIGN PATENT DOCUMENTS

| | | | |
|---|---|---|---|
| 761914 | 6/1967 | Canada | 204/81 |

OTHER PUBLICATIONS

Wawzonek, S. et al. "Polarographic Studies in Acetonitrile and Dimethylformamide", *Journal of the Electrochemical Society,* vol. 111, No. 1 (Jan. 1964), pp. 74–78.

Girard, P. et al. "Divalent Lanthanide Derivatives in Organic Synthesis: Mild Preparation of SmI2 and YbI2 and Their Use as Reducing or Coupling Agents", *Journal of the American Chemical Society,* vol. 102, No. 8 (Apr. 1980) pp. 2693–2695.

Rollin et al., *J. Chem. Research* (S), 322–323 (1981).

Schiavon et al., *J. Chem. Soc. Dalton Trans.,* 5, 1074–1081 (1981).

Wellmann et al., *Synthesis,* 901–902 (1978).

*Primary Examiner*—John F. Niebling

*Assistant Examiner*—Isabelle Rodriquez

[57] ABSTRACT

An improved process for the electrochemical reaction of a lower organic halide, e.g., benzyl chloride, wherein the improvement comprises the catalytic in situ conversion of the lower organic halide to a higher organic halide, e.g., benzyl iodide, which reacts under milder conditions than does the lower organic halide. An example of such an improved process is the dimerization of a benzyl chloride to form a diphenylethane wherein a catalytic amount of sodium iodide is added to the electrochemical cell under conditions such that the conversion of the benzyl chloride to benzyl iodide is effectively driven to completion.

18 Claims, No Drawings

ELECTROCHEMICAL ORGANIC REACTIONS VIA CATALYTIC HALIDE SUBSTITUTION

BACKGROUND OF THE INVENTION

This invention is related to processes for the electrochemical reduction or oxidation of organic halides.

Several types of electrochemical redox reactions are known including, for example, dimerizations, internal cyclizations, polymerizations and oxidative and reductive substitutions. Many of these types of reactions are useful in the preparation of pharmaceuticals, agricultural intermediates and other monomers useful in the production of specialty chemicals.

An example of an electrochemical redox reaction that has been well studied is the dimerization of organic halides. One example of such a reaction is the coupling of an allyl halide to form hexadiene. The problems concerning electrochemical reductive dimerizations include selective reduction of the halide functional group with respect to other functional groups, the solvent and the desired dimer.

Various approaches to the solution of this problem exist. U.S. Pat. No. 4,253,921 discloses a method for the electrochemical preparation of an $\alpha$, $\omega$-polymethylene diol from the coupling of polymethylene halohydrin wherein the halogen of the halohydrin is iodine or bromine. Another process for the preparation of 1,4-butanediol by the electrochemical coupling of a halohydrin in a divided electrochemical cell having a copper cathode is disclosed in U.S. Pat. No. 4,324,625. Again, the halogen of the halohydrin is iodine or bromine.

Additional electrochemical reactions of organic halides including catalytic electrochemical reduction or nucleophilic substitution are discussed by Rollin et al. in *J. Chem. Research* (*S*), 322–323 (1981). The use of an unstable nickel species in a low valence state to catalyze the reactions is disclosed. The electrochemical coupling of organic halides in the presence of a Ni(II)/Ni(I)/-Ni(0)-$PPh_3$ catalyst system is discussed by Schiavon et al. in *J. Chem. Soc. Dalton Trans.*, 5, 1074–1081 (1981). The electrochemical reductive coupling of benzylic and allylic halides using catalytic amounts of Cr(II) which is regenerated during the process is disclosed by Wellmann et al. in *Synthesis*, 901–902 (December, 1978). Each of these catalytic electrochemical reactions of organic halides show some utility when the halogen involved is iodine, bromine or chlorine.

Thus, electrochemical reactions involving organic halides are generally useful only (1) when the organic halides are limited to compounds containing iodine or bromine, or (2) when expensive and/or toxic catalytic systems are used.

U.S. Pat. No. 3,876,514 teaches that, in the electrolysis of olefinic halides to produce dienes, allyl chloride may be converted to allyl bromide so that the reaction may take place under the milder conditions needed in the bromide reaction Wawzonek et al., *J. Electrochem. Soc.*, 111, 74 (1964) teach that organic chlorides are reduced at more negative potentials than corresponding iodides or bromides. They also teach that in some cases an organic chloride will undergo displacement with iodide or bromide ions to yield the organic bromide or iodide which will be reduced at the less negative potential.

However, in these situations, it is generally taught that at least a stoichiometric amount of the iodide or bromide ions must be present. Further, the replacement reactions wherein the chloride is exchanged with iodide or bromide are not completely efficient. Even when the partial exchange has been affected, the use of the milder conditions appropriate for the iodide or bromide reactant does not result in conversions and yields that would be expected if the reactant were completely in the form of an iodide or bromide.

Thus, what is needed is an efficient method of converting organic chlorides to organic bromides or iodides. Such a method used in conjunction with known electrochemical reactions would permit both the use of relatively inexpensive organic chlorides as starting materials and the milder reaction conditions associated with the reactions of organic iodides and bromides.

SUMMARY OF THE INVENTION

The present invention is such an improved process for an electrochemical reaction of a lower organic halide, the improvement comprising the catalytic in situ conversion of the lower organic halide to a higher organic halide via the addition of a catalytic amount of a higher halide under reaction conditions such that the conversion of the lower organic halide to the higher organic halide is effectively driven to completion.

It is surprising that the use of only a catalytic amount of the higher halide results in an electrochemical reaction using as reactant the less expensive lower organic halide and the less stringent and therefore less expensive reaction conditions associated with the more expensive higher organic halide.

The improved process of this invention is useful in a wide variety of electrochemical reactions including, but not limited to, dimerizations, internal cyclizations, polymerizations and oxidative and reductive substitutions. Products produced from these reactions include pharmaceuticals, agricultural intermediates useful in the preparation of herbicides and pesticides and monomers useful in the production of specialty chemicals such as substituted biphenyl ethanes, cyclopropanes, cyclobutanes, diols and dienes.

DETAILED DESCRIPTION OF ILLUSTRATIVE EMBODIMENTS

The process of this invention involves the replacement of the halide of the lower organic halide with a higher halide wherein the lower organic halide is defined to mean an organic chloride or an organic bromide and higher halide is defined to mean bromide or iodide. Generally, lower halide refers to one which is lower in atomic weight while higher halide refers to one which is higher in atomic weight. The higher halide species, an organic bromide or organic iodide, is formed catalytically in situ and never isolated. It is this species that is actually reduced or oxidized to form the reactive intermediate which undergoes conversion to the actual product. It is desirable that the organic iodide or bromide species, in the case where the lower organic halide is a chloride, or the organic iodide, in the case where the lower organic halide is a boromide, be the reactant in the electrochemical reaction since the potential necessary for the transformation of the less electronegative halides is generally lower.

In a preferred embodiment, the lower organic halide is an organic chloride and the higher organic halide is an organic iodide.

The improved process of this invention is useful in a wide variety of electrochemical reactions involving organic halides as starting materials. Specifically, the improved process of this invention is useful in a number of chemical-electrochemical-chemical (CEC) reactions involving organic halides. These processes involve a chemical reaction, the catalytic halide exchange, followed by an electrochemical reaction, e.g., the removal or addition of one or more electrons, followed by a second chemical reaction wherein the product is formed, e.g., a substitution, a dimerization or a polymerization.

The equilibrium of the halide exchange reaction generally favors the organic chloride rather than the organic iodide or organic bromide, or the organic bromide rather than the organic iodide. Thus, it is necessary that conditions which drive the equilibrium of the halide exchange reaction toward the higher organic halide be used in the practice of this invention. The use of conditions that favor the formation and precipitation of a chloride salt thus removing the chloride ion from the reaction system at a rate consistent with the rate at which it is formed is one example of a set of conditions which drive the equilibrium toward the higher organic halide A second example is the selective removal of chloride ion via other methods such as nucleophilic substitution onto an electrogenerated cationic species in a paired synthesis. A third example is the removal of the chloride ion via a chloride ion selective membrane. Other methods of driving the equilibrium of the halide exchange reaction to the higher organic halide are known to those skilled in the art and can be selected depending on the conditions of the overall reaction.

Any organic chloride or organic bromide which will undergo halide substitution is useful in the practice of this invention. Examples of organic halides wherein the halide is chloride or bromide which are useful in the practice of this invention include alkyl halides, allyl halides, arylalkyl halides and aryl halides. It should be noted that in each instance, the organic halide may be a monohalide or a polyhalide. Preferably, the arylalkyl halide is activated. An activated arylalkyl chloride or bromide is one such as benzyl chloride which will undergo facile halide substitution in the absence of a catalyst such as, for example, Ni(O). It is more preferred that alkyl chlorides or activated arylalkyl chlorides be used in the practice of this invention. An example of an activated arylalkyl chloride useful in the practice of this invention is benzyl chloride ($\alpha$-chlorotoluenes). Examples of alkyl chlorides include both mono and poly chlorinated straight or branched chain alkanes such as butyl chloride and unsaturated chlorides such as allyl chloride. The organic halide reactants may further contain additional inert substituents. Inert substituents are those which are less easily reduced or oxidized than the organic iodides or organic bromides which are produced in situ and do not interfere with the process of the invention.

Any concentration of the lower organic halide may be used which results in the formation of the desired product by the practice of this invention. It is preferred that the concentration be greater than about 1 molar. However, depending on the particular CEC reaction or process, the concentration of the lower organic halide may be larger or smaller.

The higher halide useful in the practice of this invention is selected from the group consisting of iodide and bromide. It is preferred to use iodide. The concentration of the higher halide useful in the practice of this invention is any which, under the conditions of the invention, result in the catalytic exchange of higher halide for lower halide. The exchange is catalytic when each higher halide ion undergoes exchange with a lower halide more than once, or has a turnover number greater than 1. The turnover number thus indicates the number of times higher halide undergoes exchange with the lower halide.

The concentration of the higher halide useful in the practice of this invention will vary depending on whether the reaction is conducted in a batch, semi-batch or continuous manner, any of which is suitable. In a batch reaction, it is preferred that the concentration of the higher halide be at least about 1 percent of that of the lower halide and no more than about 95 percent. It is more preferred that the concentration of the higher halide is at least about 10 percent and no greater than about 50 percent of that of the lower halide. It is most preferred, in a batch reaction that the concentration of the higher halide is about 10 percent of that of the lower halide.

In a semi-batch process wherein the electrolysis is run, the product is removed and the mother liquor containing the higher halide is reused, the concentration of the higher halide in the mother liquor may be maintained at or near saturation to promote a faster reaction. In this situation, while the concentration of higher halide at any given time may be higher than the concentration of the lower organic halide, the amount of the higher halide consumed is substoichiometric when compared to the amount of lower organic halide used and the amount of product produced. Similarly, if the process is run in a continuous manner, the concentration of the higher halide may be maintained at a relatively high level while the amount of higher halide consumed in the reaction remains substoichiometric when compared to the amount of lower organic halide used and product produced.

Any compound containing iodine or bromine which will undergo halogen exchange with the lower organic halide is useful as a source of the higher halide in the practice of this invention. Examples of such compounds include higher organic halides such as alkyl, aralkyl, aryl, allyl, and vinylic halides, inorganic halide salts such as sodium bromide or sodium iodide and organic salts such as quaternary ammonium salts. The higher halide is preferably provided in the form of a halide salt corresponding to the formula MX wherein X is I or Br and M is a Group I or II metal, $NH_4$, a quaternary amine or other source of labile iodide or bromide ion. It is preferred that X is I. It is also preferred that M is a Group I metal or a quaternary amine. It is more preferred that M is Na.

Electrolytes useful in the practice of this invention include the salts of the higher halide identified above. Non-reactive electrolytes may be used in conjunction the higher halides. Non-limiting examples of such non-reactive electrolytes include alkali, alkaline earth metal and quaternary ammonium salts. Examples of counter-ions useful for such salts are perchlorates, $BF_4^-$, $BF_6^-$, $PO_4^=$, $HPO_{a4}^-$, and $SO_4^=$.

A solvent is advantageously used in the process of this invention. The solvent may be aqueous or nonaqueous, protic and aprotic depending on the nature of the CEC reaction which uses the improved process of the present invention. It is preferred to use an aprotic solvent. Examples of preferred solvents include acetone, dimethylformamide, acetonitrile, dimethyl sulfoxide and methanol. It is preferred to use acetonitrile as solvent.

The process of this invention may be carried out in any conventional electrochemical cell known in the art. It is preferred to use a multi-compartment cell in which a membrane or diaphragm separates the anode and cathode compartments. Either a constant current or a constant potential is required. Any current density which will result in the formation of the product under the conditions of the process of this invention is useful. It is preferred that the current density is at least about 1 mA $cm^{-2}$ and no greater than about 300 mA $cm^{-2}$. It is more preferred that the current density be at least about 10 mA $cm^{-2}$ and no greater than about 100 mA $cm^{-2}$. It is also preferred that a working electrode potential past the halfwave potential of the higher organic halide substrate be used.

Cathode materials useful in the process of this invention are those at which the secondary halide may be electrochemically reduced. Examples of materials useful as cathodes include stainless steel, aluminum, carbon, Group IB metals, Group IIB metals and Group VIIIA metals. In a preferred embodiment, the cathode is Au. Anode materials useful in the practice of this invention include Pt, Mg, Ru on Ti and C. In a preferred embodiment, the anode is Pt.

Additionally, electrode materials which catalyze the halide substitution as well as allow the electrochemical reaction are preferred in the practice of the process of this invention. Examples of such electrode materials include nickel.

Any temperature and pressure at which the process of this invention will function is useful. It is preferred that the temperature be greater than the freezing point of the solvent and less than the boiling point of the solvent. It is more preferred that the temperature be at least about 10° C. and no greater than about 60° C. It is preferred that the pressure be at least atmospheric and no greater than about 1000 psi. It is more preferred that the pressure be at least about atmospheric and no greater than about 100 psi. The process of this invention may be conducted under an inert atmosphere such as nitrogen or in the presence of a reactive atmosphere such as $CO_2$.

The following example is given for illustrative purposes only and is not to be considered as limiting the invention in any way. Unless stated otherwise, all parts and percentages are given by weight.

EXAMPLE 1

Electroreductive Dimerization of Benzyl Chloride

The electrolysis is performed in a three-compartment cell with a 5-$cm^2$ Au flag cathode separated from a Pt coil anode with a medium glass frit. A SCE reference electrode is separated from the catholyte by two ceramic frits with KCl bridges. Benzyl chloride (8.69 mmole) in 9.0 ml of acetonitrile/1 M sodium perchlorate under nitrogen is subjected to potentiostatic electrolysis at −1.2V. Negligible current passes. A one-ml (1.15-mmole) portion of NaI stock solution is added to the catholyte and the current increases to a maximum of 65 mA at 1.5 hours and then decreases. A white precipitate falls to the floor of the cathode compartment. The electrolysis is terminated when the charge passed is equal to approximately 60 percent of the theoretical charge. The catholyte is analyzed by gas chromatography (OV-101, 100° C.–250° C./32° C. $min^{-1}$). ). major product is 1,1-diphenylethane. A current efficiency of about 90 percent based on diphenylethane is obtained which indicates over four catalytic turnovers of iodide.

What is claimed:

1. A process for converting a lower organic halide compound to an organic product compound comprising (1) a first chemical reaction wherein the lower organic halide compound is catalytically in situ converted to a higher organic halide compound by the addition to the lower organic halide compound of a catalytically effective amount of a higher halide compound with the proviso that reaction conditions are such that the conversion of the lower organic halide compound to the higher organic halide compound is essentially complete;

(2) an electrochemical reaction comprising reducing, at a potential less negative than that required to reduce the lower organic halide compound, the higher organic halide compound formed in step (1) to (a) a reduced organic compound and (b) the higher halide ion catalyst; and (3) a second chemical reaction wherein the reduced organic halide compound formed in step (2) reacts under conditions sufficient to form the organic product compound;

wherein the step (2) is carried out in the presence of a cathode selected from the group consisting essentially of stainless steel, aluminum, carbon, Group 1B metals, and Group VIIA metals and an anode selected from the group consisting essentially of platinum, magnesium, ruthenium or titanium and carbon.

2. The process of claim 1 wherein the lower organic halide compound is an organic chloride.

3. The process of claim 1 wherein the higher organic halide compound is selected from the group consisting of organic bromides and organic iodides.

4. The process of claim 3 wherein the higher organic halide compound is an organic iodide.

5. The process of claim 1 wherein the higher halide compound is a compound corresponding to the formula MX wherein X is selected from the group consisting of I and Br and M is selected from the group consisting of a Group I metal, a Group II metal, $NH_4$, and a quaternary amine.

6. The process of claim 5 wherein the higher halide compound is sodium iodide.

7. The process of claim 1 wherein the lower organic halide compound is benzyl chloride.

8. The process of claim 1 wherein the electrochemical reaction is carried out as a batch reaction.

9. The process of claim 8 wherein the catalytic amount of the higher halide compound is a concentration which is at least about 1 percent of the concentration of the lower organic halide and no greater than about 95 percent of the concentration of the lower organic halide.

10. The process of claim 9 wherein the catalytic amount of the higher halide compound is a concentration which is at least about 10 percent of the concentration of the lower organic halide and no greater than about 50 percent of the concentration of the lower organic halide.

11. The process of claim 10 wherein the catalytic amount of the higher halide compound is a concentration which is about 10 percent of the concentration of the lower organic halide.

12. The process of claim 1 wherein a solvent is employed.

13. The process of claim 1 wherein the conversion of the lower organic halide to the higher organic halide is driven effectively to completion by the formation of an inorganic salt of the lower halide which precipitates out of the catholyte.

14. The process of claim 1 wherein the conversion of the lower organic halide to the higher organic halide is driven effectively to completion by the selective removal of the lower halide.

15. The process of claim 1 wherein benzyl chloride is converted to benzyl iodide via the addition of a catalytic amount of sodium iodide and the benzyl iodide so formed is electrochemically dimerized to form diphenylethane.

16. The process of claim 1 wherein the electrochemical reaction is carried as a continuous reaction.

17. The cathode of claim 1 wherein the cathode consists of gold.

18. The anode of claim 1 wherein the anode consists of platinum.

* * * * *

UNITED STATES PATENT AND TRADEMARK OFFICE

CERTIFICATE OF CORRECTION

PATENT NO. : 4,904,370

DATED : February 27, 1990

INVENTOR(S) : KENNETH J. STUTTS

It is certified that error appears in the above-identified patent and that said Letters Patent is hereby corrected as shown below:

Col. 2, line 60, "boromide" should read -- bromide --.

Col. 3, line 19, -- ( -- should be inserted before "thus" and in line 21 -- ) -- should be inserted after "formed".

Col. 4, line 61, "$HPO_{a4}$-" should read -- $HPO_4^-$ --.

Col. 5, line 68, -- The -- should be inserted before "major".

Col. 6, line 27 (Claim 1), the first occurrence of "the" should be deleted;
line 32, "or" should read -- on --.

Signed and Sealed this

Sixteenth Day of July, 1991

*Attest:*

*Attesting Officer*

HARRY F. MANBECK, JR.

*Commissioner of Patents and Trademarks*